United States Patent [19]

Lancaster et al.

[11] 4,110,957

[45] Sep. 5, 1978

[54] REVERSE WRAP

[76] Inventors: William G. Lancaster, 5101 Upper River Rd., Louisville, Ky. 40222; Patrick R. Lancaster, 2906 N. Osage, Louisville, Ky. 41076

[21] Appl. No.: 730,612

[22] Filed: Oct. 7, 1976

Related U.S. Application Data

[63] Continuation-in-part of Ser. No. 594,506, Jul. 9, 1975, abandoned.

[51] Int. Cl.[2] ..... B65B 13/04

[52] U.S. Cl. ..... 53/589; 100/28

[58] Field of Search ..... 53/198 R, 210; 100/27, 100/28

[56] References Cited

U.S. PATENT DOCUMENTS

| | | | |
|---|---|---|---|
| 2,088,133 | 7/1937 | Evans | 100/28 |
| 2,124,770 | 7/1938 | Evans | 100/28 |
| 2,596,428 | 5/1952 | O'Malley | 292/75.4 |
| 2,630,751 | 3/1953 | Cranston et al. | 53/198 R X |
| 2,687,082 | 8/1954 | Cranston, Sr. | 100/28 |
| 2,837,884 | 6/1958 | Gibbons | 100/27 X |
| 2,941,464 | 6/1960 | Cranston, Jr. | 100/28 |
| 2,982,065 | 5/1961 | Giles et al. | 53/198 R X |
| 3,003,297 | 10/1961 | Broadhead et al. | 53/198 R X |
| 3,309,839 | 3/1967 | Lyon | 100/27 |
| 3,324,789 | 6/1967 | Buettner | 53/198 R X |
| 3,820,451 | 6/1974 | Tanaka | 100/27 X |
| 3,910,005 | 10/1975 | Thimon et al. | 53/198 R X |

*Primary Examiner*—John Sipos

*Attorney, Agent, or Firm*—Gipple & Hale

[57] ABSTRACT

An apparatus for wrapping a plurality of loads into a wrapped package comprising a conveyor adapted to receive a plurality of loads and a film dispensing apparatus. This film dispensing apparatus comprises a frame, a ring member rotatably mounted on the frame, a film roll support and brake member mounted on the ring member. A guide wrapping rail is aligned with the conveyor to receive and carry loads transported by the conveyor and is so positioned that one end passes through the ring member. A material handling assembly having two clamp mechanisms, is positioned adjacent the dispenser apparatus. One of the clamp mechanisms is adapted to alternately hold the leading edge of a roll of stretchable material carried by the ring member film roll support in a fixed position while the other clamp mechanism holds the trailing edge of the stretchable material to form the package wrap. Each clamp mechanism comprises two opposing bar members and a cutting blade secured to one bar member with its cutting edge being positioned between the two bar members for severing the web of the last wrap of overwrap material placed around the load. A drive wheel engages the ring member to alternately rotate the ring member in alternate opposite directions so that it dispenses material around the guide rail, the clamp mechanisms, and the load currently being carried by the guide rail with the brake member stretching the material as it is being placed around the load.

23 Claims, 10 Drawing Figures

36
34
42
46
44
44
45
38
39
66
68
58
69
22
72
34
36
66
50
32
30
SEE DETAIL OF DRIVE TRAIN BELOW.
48
47
30
DETAIL DRIVE TRAIN

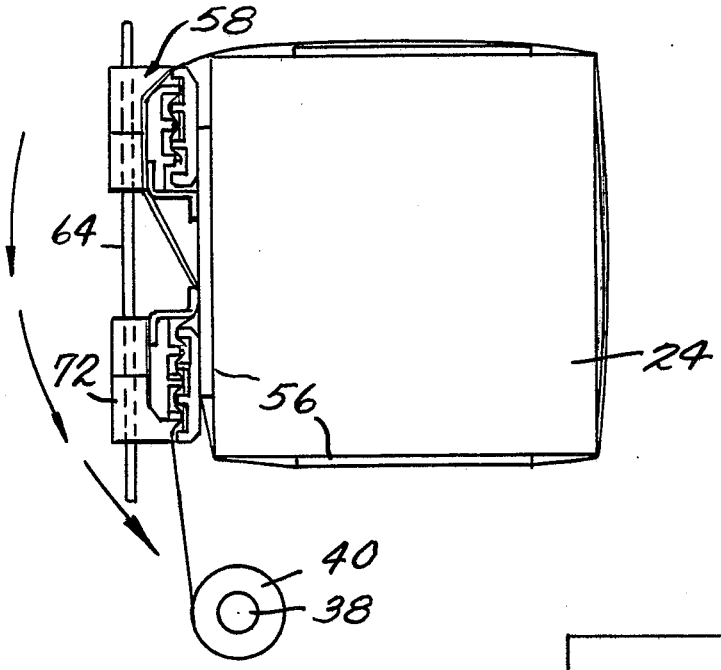
Fig. 8.
Fig. 10.
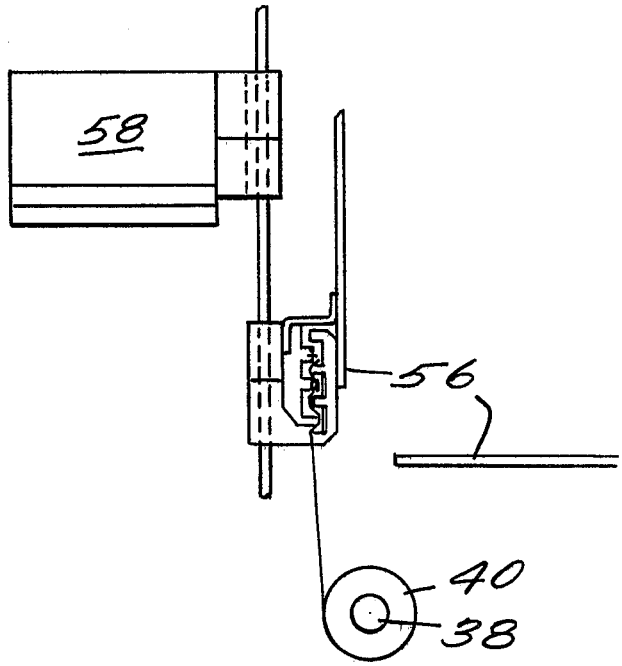
Fig. 9.
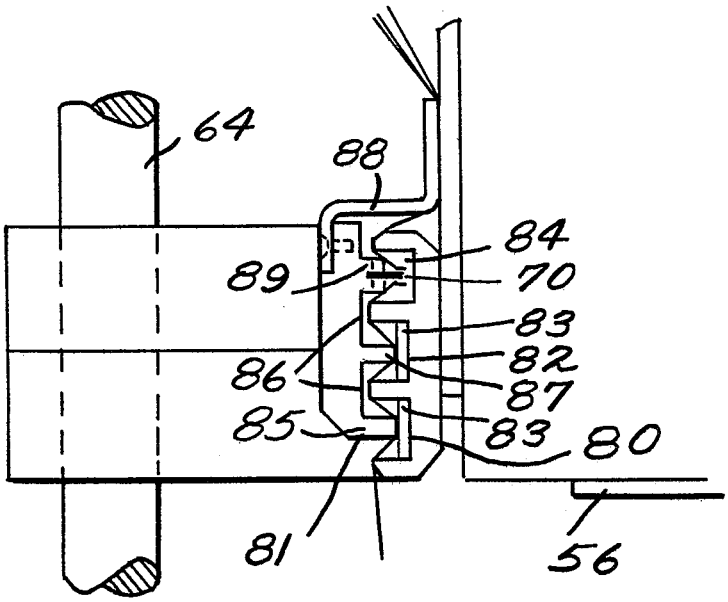

REVERSE WRAP

RELATED APPLICATIONS

This is a continuation-in-part of U.S. Application Ser. No. 594,506 filed July 9, 1975 now abandoned.

BACKGROUND OF THE INVENTION

The present invention generally relates to packaging and more particularly to a method and apparatus for making unitary packages holding a plurality of components with each package containing a load that has a covering of a web of material wrapped around it.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,509 and 3,514,920. A discussion of this art is set forth in U.S. Pat. No. 3,867,806.

The present invention provides a simple more reliable and cheaper method of unitizing multiple unit products into a unitary package.

When the present process and apparatus is compared with other apparatus and processes currently used to pack products in corrugated boxes and the cost of the corrugated boxes themselves, the invention shows an enormous cost savings. The invention has comparable costs with kraft wrap but it gives a much tighter and better unitized package than that possible with kraft wrap. In addition to these factors the invention has a product visiblity which is not present in boxes and kraft wrap. When the invention is compared with more existing shrink film systems the proposed system offers packaging speed, reliability of package seal and energy savings in that less energy is required to package the products.

A basic problem with shrink packaging is that the primary strength and reliability of the package is determined by the consistent quality of the seals. These seals depend on a careful maintenance of the sealing jaw and are never as strong as the film itself. The time that it takes to make the seals is a limiting factor on the possible speeds of most shrink systems.

The present invention may or may not require a structural seal depending upon the film type which is used with the invention. The invention is designed to function with either film types such as P.V.C. that have sufficient tack not to require heat sealing or with film types such as polyethylene that require heat sealing. In the present invention the system provides for a sealing mechanism which effectively seals the outer layer of film to the layer under it simultaneously as the trailing edge of the film is severed from the load. Thus the time limitation to make the seal occurs with the severing of the packaged load so that the packaging speed is unaffected.

The use of wrapping machinery in the art is known and one such apparatus is shown by U.S. Pat. No. 3,003,297 in which tape is placed by a rotating ring on a box carried by a conveyor line. A complex cutting and holding mechanism is used to place the tape on each box and cut it off with the process being repeated for each box. The use of the adhesive on the tape to bond it to the package is an integral part of the function of this concept. Without this adhesion it would not work either in single, multiple or spiral configurations. The unique design and function of the clamps in the present invention do not require a bonding of the film to the product in order for the system to operate.

U.S. Pat. No. 2,088,133 discloses a reverse wrapping wire tying machine. In the reference a gripper mechanism holds the band in position with respect to the load to be wrapped and a rotatable ring drive rotates the band around the load until the band has completed more than one wrap of the load and passes over the body of the gripper. A separator slide is used to separate the leading edge of the band from the underlying band and a second gripper mechanism attaches to the separated band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction on another load with the various gripping and cutting mechanisms functioning in the same manner.

The significant improvements of this invention over reference U.S. Pat. No. 2,088,133 are; its ability to wrap multiple layers, its ability to handle stretch film, its ability to spiral wrap, and its extremely simplified operation and construction. It should be noted that U.S. Pat. No. 2,088,133 requires eleven separate complex mechanisms and ten operations to accomplish a clamping function that the present invention does with four simple mechanisms and four operations.

Other references of interest which are pertinent to rotatable drives for wrapping packages are disclosed in U.S. Pat. Nos. 3,820,451, 3,331,312, 3,324,789, 3,309,839, 3,207,060, 2,743,562, 2,630,751, 2,330,629, 2,054,603 and 2,124,770. A similar reference of interest is U.S. Pat. No. 2,982.065.

Another application in packaging is shown by U.S. Pat. No. 3,514,920 in which heat shrink film is wrapped around a pallet supporting a plurality of cartons. Furthermore, it is also known in the art to spirally wrap articles. Such spiral wrapping is shown in U.S. Pat. Nos. 3,778,199, 3,549,077, 3,191,289 and 2,716,315.

The present invention uses stretchable plastic film in its preferred embodiment since the mechanical stretching of the film utilizes its strength better than a heat shrink wrap. The elasticity in the film holds the products under more tension than either the shrink wrap or the kraft wrap particularly with products which settle or relax when packaged.

Various apparatus and processes have been developed by the present inventors to utilize stretch material in package wrapping. Such apparatus and processes are disclosed in U.S. Pat. No. 3,867,806 and U.S. Pat. applications Ser. No. 454,477, 478,523 now abandoned and 568,269 now U.S. Pat. No. 4,050,220which have been filed by the present named inventors of this invention. These applications are incorporated herein in their entirety in this application by reference.

Additional benefits occur in the present invention over the prior art in that no changeover is required in handling random size units of a variety of materials as the apparatus is constructed to handle such random size units. Furthermore, the apparatus provides a substantially continuous wrapping operation so that loads can be wrapped at any desired speed and for any time period since the invention can be equipped with an automatic roll changing mechanism. A significant economic factor is also present in the present invention as the power requirements are significantly less than those of shrink systems since there is no heat tunnel required and greater speeds of operation are possible because of the elimination of the conventional heat seal which is used in shrink type wrapping. However, the invention can be used to place shrink film on a load that is then run through a shrink tunnel. Because of the simplicity of the construction of the invention there is a greater stability of the wrapping apparatus with less maintenance being required to maintain the apparatus and a corresponding reduction in breakdown time. Another desired characteristic resulting from the apparatus construction is that the invention can be operated in any plane thus allowing it to be used in various space saving positions.

SUMMARY OF THE INVENTION

The present invention generally comprises a novel apparatus and process for making unitary packages in a substantially continuous reverse wrapping process. In the apparatus a series of loads each containing a plurality of boxes are singlularly fed into a wrapper apparatus on a guide rail with the boxes being aligned by an aligning mechanism.

The leading edge of the film from the wrapper apparatus is held by clamp mechanisms of a film handling assembly positioned adjacent the load and the wrapper apparatus is rotated to wrap the load, guide rail and clamp mechanism with a stretchable film in a counterclockwise direction. The stretched film is held by the clamp mechanisms, simultaneously severed from the wrapper apparatus and bonded to the underlying film layer wrapped around the load. A second load is fed into the wrapping apparatus pushing the wrapped packaged load onto a takeoff conveyor which carries the packaged load away to another area. The second load is then wrapped with stretchable material in an opposite direction by the wrapping apparatus with each successive load being handled by alternating clamp apparatus of the clamp mechanisms as previously described and wrapped with stretch material in a opposite direction from the direction of wrap of the preceeding load.

Although the invention will be set forth in the claims, the invention itself and the manner in which it may be made and used, may be better understood by referring to the following description taken in connection with the accompanying drawings forming a part hereof in which like reference numerals refer to like parts throughout the several views and which:

BRIEF DESCRIPTION OF THE DRAWINGS

FIG. 8 is a schematic view of the second clamp bar assembly of the clamp mechanism clamping the film and severing the film;

FIG. 9 is an enlarged view of the second clamp bar assembly of FIG. 8; and FIG. 10 is a schematic view of the first step of the reverse wrap invention.

DETAILED DESCRIPTION OF THE DRAWINGS

Figure 1:
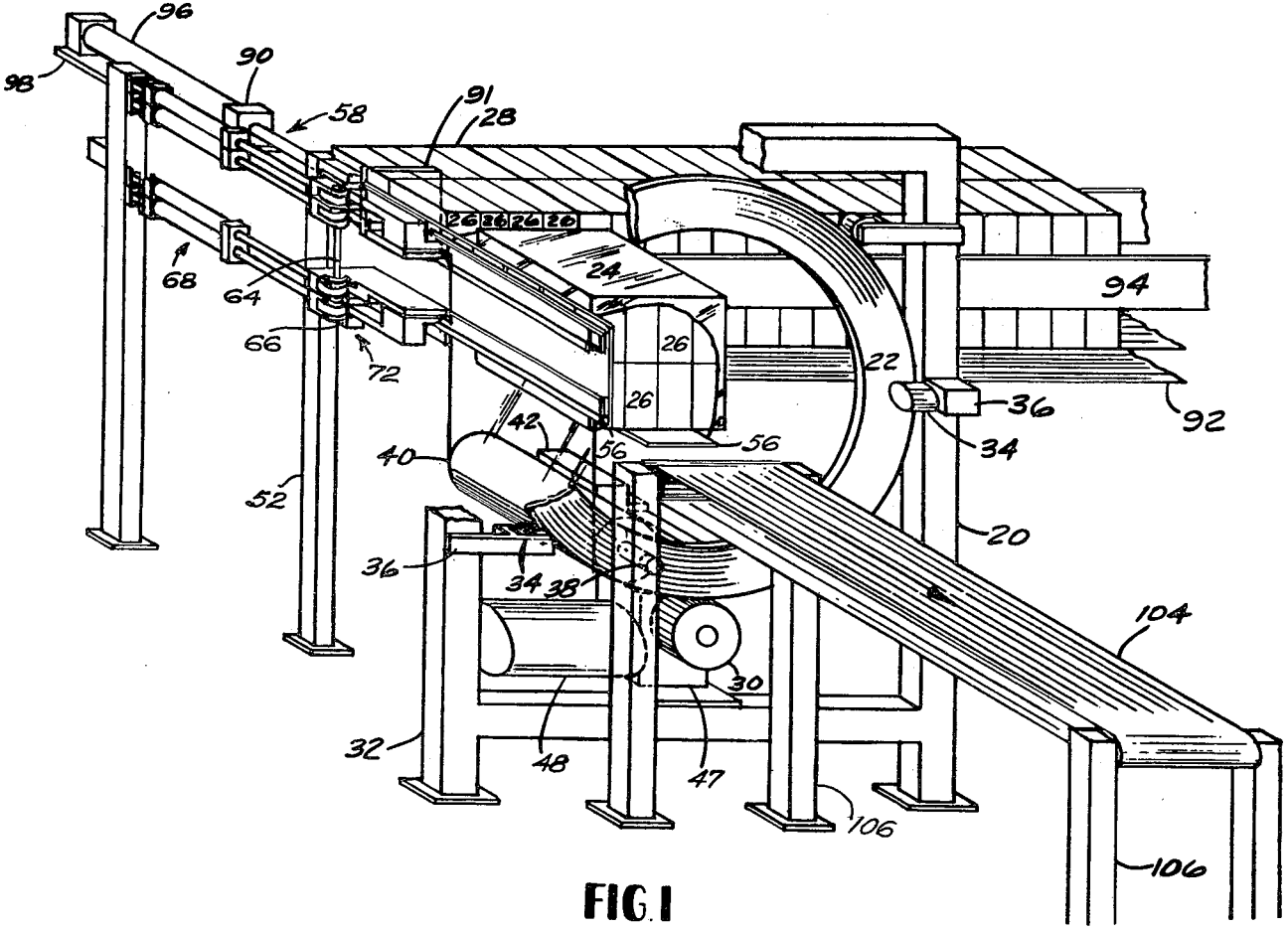
FIG. 1 is a perspective view partially in section of the inventive apparatus.
Figure 2:
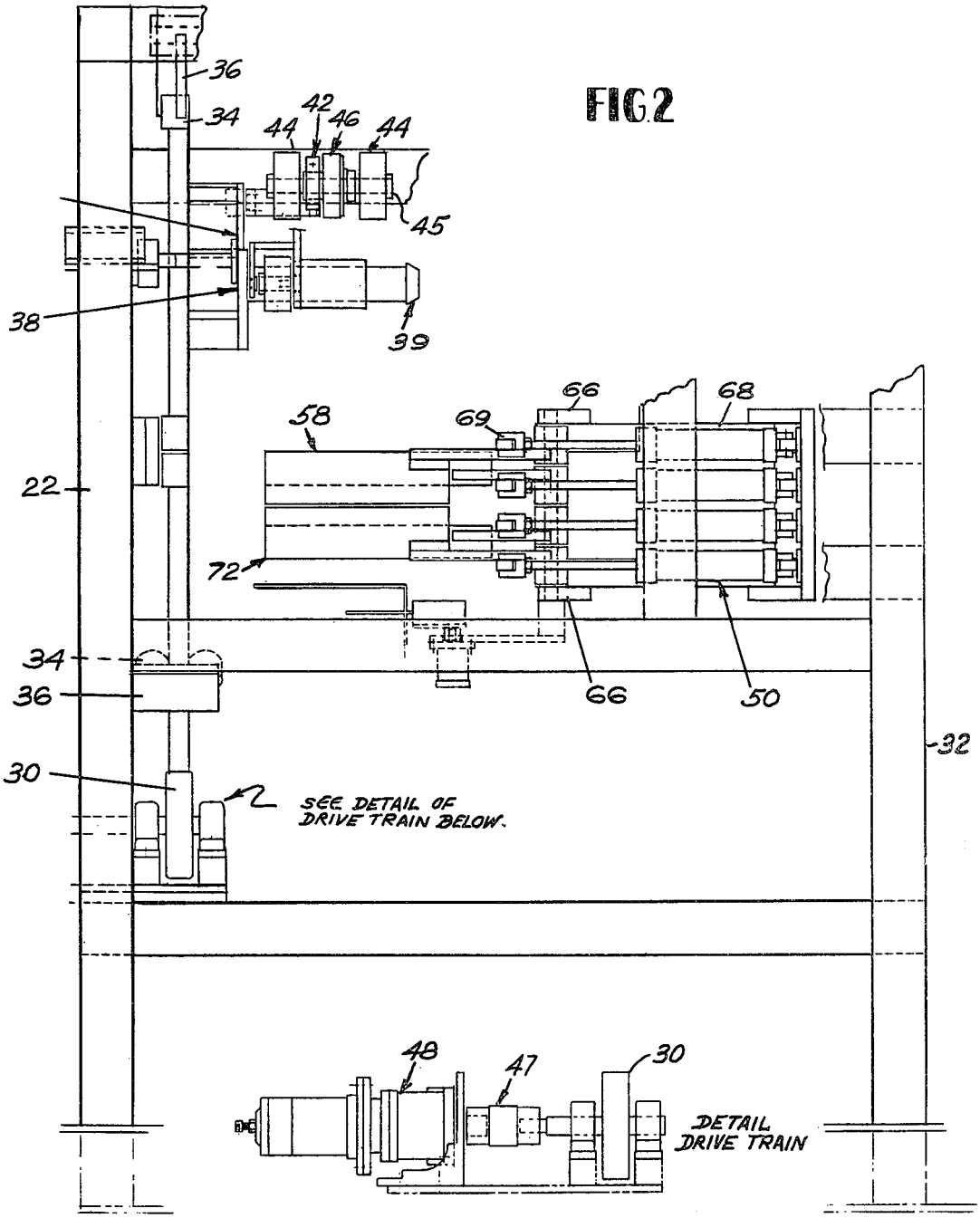
FIG. 2 is a side elevation view of a similar apparatus such as the one disclosed in FIG. 1 with various components removed.
Figure 3:
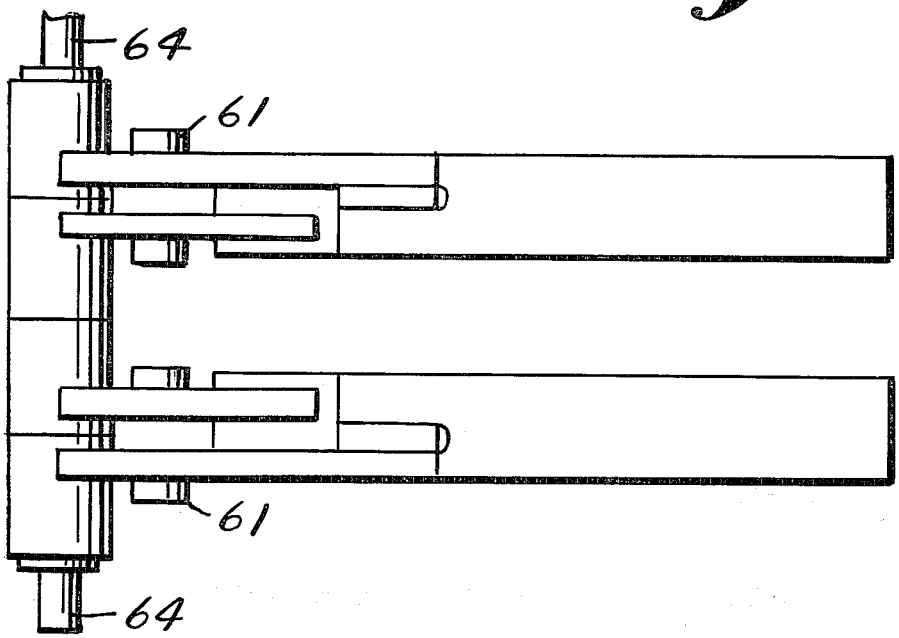
FIG. 3 is a top plan view of the clamp mechanisms of FIG. 1 with center portion broken away.
Figure 4:
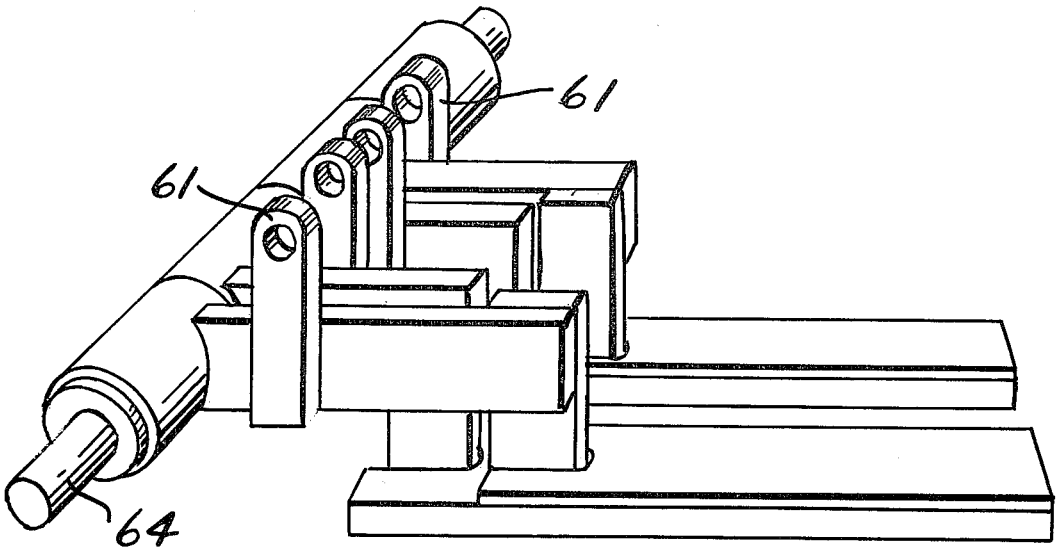
FIG. 4 is a perspective view of the clamp mechanisms of FIG. 3 with the clamp mechanisms abutting each other.
Figure 5:
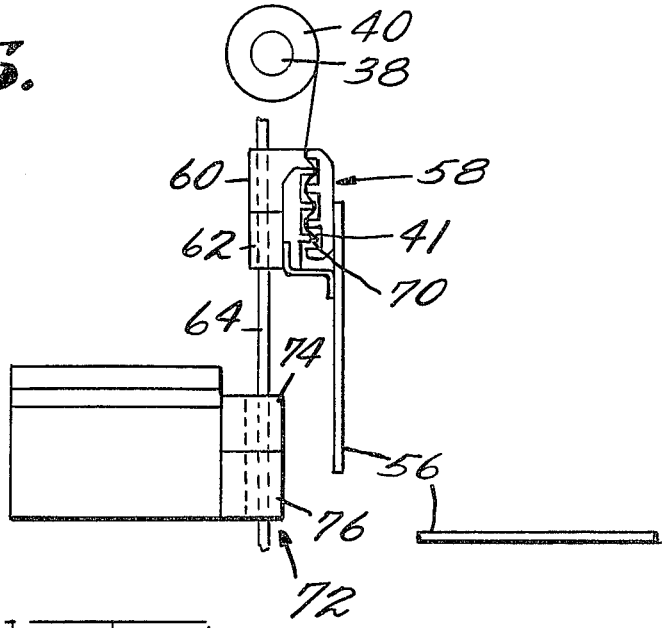
FIG. 5 is a schematic view of the invention of FIG. 1 showing the clamp mechanism in the first step of the packaging process.
Figure 6:
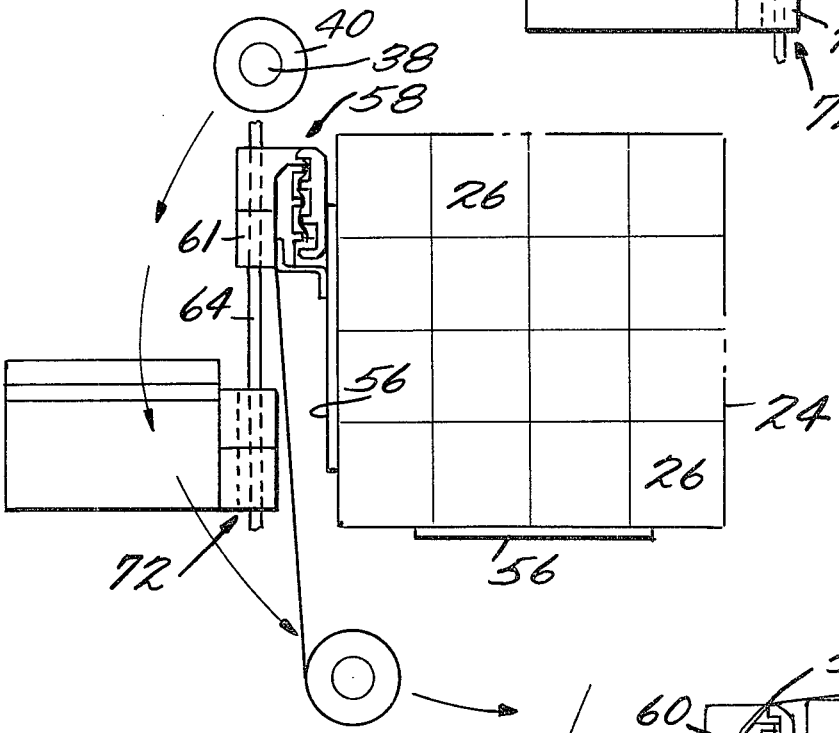
FIG. 6 is a schematic view of the clamp mechansims of FIG. 5 after a partial revolution of the film roll.

The present invention is shown by the accompanying drawings 1–10. The preferred embodiment of the apparatus is shown in FIGS. 1 and 2 and the wrapping process of the preferred embodiment is shown in FIGS. 5–10.

In the invention the numeral 20 designates a reverse load wrapping apparatus. In the wrapping apparatus a doughnut or ring shaped roll support member 22 is supported and positioned so that it can encompass a load 24 comprising a composite plurality of boxes 26 with a wrap of film material. The loads are carried into the roll support member by an infeed conveyor.

The roll support member 22 is ring shaped and of sufficient diameter so that a load 24 can pass through it and is adapted to be rotatably driven by a chain drive not shown or a roll drive wheel 30 so that it can dispense a film wrap around the load. The drive wheel 30 is preferably constructed of a resilient material having a high coefficient of friction so that an efficient driving force is created. The roll support member 22 is supported by a frame 32 which guides and supports the roll support member through the use of guide rollers 34. The guide wheels or rollers 34 are rotatably mounted to brackets 36 which are secured to the frame 32 so that the support member 22 can easily rotate around the load 24. The roll support member 22 carries a film roll support shaft mechanism 38 and associated shaft 39 on which is mounted a roll of stretchable film material 40. The shaft 39 fits in the core of the film roll to hold the film roll in place. A film tension brake 42 is mounted on a bracket secured to support member 22. Brake 42 comprises a pair of rubber rollers 44 splined into a rotatable shaft 45 which extends through a multiple disc brake mechanism 46. In the brake a roller 44 is positioned on either side of the brake mechansim 46. The brake mechanism 46 contacts the shaft 45 and retards its rotation so that a predetermined tension can be placed on the rollers which are constructed so their circumferences engage the outer surface of the film roll. It is thus seen that the film roll is placed under a continuous tension as it is wrapped around the load so that a predetermined amount of stretch is delivered to the film regardless of the decreasing size of the film roll. It is important that a constant tension be provided to the film roll to prevent fluctuations in stretching the film which can cause various rates of film decay on the package after the film has been stretched and wrapped around the package. The film roll 40 is driven around the load as the roll support member 22 is driven by drive wheel 30. Drive wheel 30 is connected to a motor reducer 47 which is connected to the drive motor 48. The drive motor is adapted to reverse direction and drive the roll member 22 in an opposite direction through the use of a limit switch or other known signaling devices which sense the number of revolutions of the roll member 22.

The leading edge 41 of the web of film from the film roll is brought into engagement with the film handling assembly 50 and held in a fixed stationary position by one of the clamp mechanisms of the film handling assembly.

The film handling assembly 50 is mounted on a film handling support brace 52 secured to frame 32. The film handling assembly comprises a pair of support guide plates 56 secured to the frame 32 or an adjacent conveyor, a first clamp mechanism 58 comprising an upper bar member 60 and a bottom bar member 62, and a second clamp mechanism 72 comprising an upper bar member 74 and a lower bar member 76. The support guide plates 56 are preferably in a fixed position. However the clamp components of the film handling assembly are pivotally mounted around a shaft 64 which is journaled in brackets 66 secured to the film handling support brace 52. Each of the bar members of the clamp mechanisms 58 and 72 are provided with ear extensions 61 which are respectively connected to pneumatic cylinder assembly 68. The cylinder piston rods are formed with yoke ends 69 which receive ears 61 and are secured to the yoke ends 69 by pin means. The cylinders when activated rotate the upper and lower bars of the clamp mechanisms around the pivot shaft 64. A cutter blade 70 is adapted to fit on one of the ridges of the bar member. Bar members 60 and 76 of both clamp mechanisms have the same configuration and are positioned in mirror image. Each bar member as best shown in FIG. 9 comprises a linear body formed with three grooves 80, 82, and 84. Two of the grooves are of equal width and depth while the third groove 84 has a greater depth than the other two and is adapted to receive the cutter blade 70. The grooves 80 and 82 are preferably "T" shaped to receive resilient rubber strips 83 which serve to hold the film when the opposing ridges or fingers 81 of the opposing bar member holds the film against them.

Bar member 62 of the first clamp mechanism and bar member 74 of the second clamp mechanism have the same configuration and are positioned in mirror image. Each of the bar members comprises a linear body defining two grooves 86, and three ridges or fingers 85, 87 and 89. A cutter bar 70 is mounted to finger 89 and is constructed to extend into channel 84. An angle bar 88 is secured to the bar body and forms a guide which contacts the film and holds it in place against the underlying film layer. The pneumatic cylinders 68 are secured to the support brace 52 and respectively adapted to activate bar members 60, 62, 74 and 76. Support guide plates 56 are secured to the film handling support brace 52 and are adapted to receive the load 24.

The load 24 is transported onto a load inserter mechanism 90 by means of an infeed conveyor 92. Guide rails 94 are positioned above the infeed conveyor on either side of the belt so that the loads 24 will not fall off of the belt during transportation of the loads to the load inserter mechanism 90. Once the load 24 is placed on a bottom guide plate by the infeed conveyor adjacent the inserter mechanism, the load is pushed into place by a load inserter plate 91. The inserter plate is connected to a pneumatic cylinder 96 which is secured to a support 98. The infeed configuration is shown in FIG. 1 of the present case. When the load 24 has been pushed into position by the load inserter mechanism it is aligned with the film roll support member 22 and wrapped with film from the film roll. After wrapping, the load is pushed from the wrapping area by the following load onto a takeaway conveyor 104 mounted on supports 106. The endless belt conveyor 104 then transports the stretch wrapped load to a suitable depository.

Figure 7:
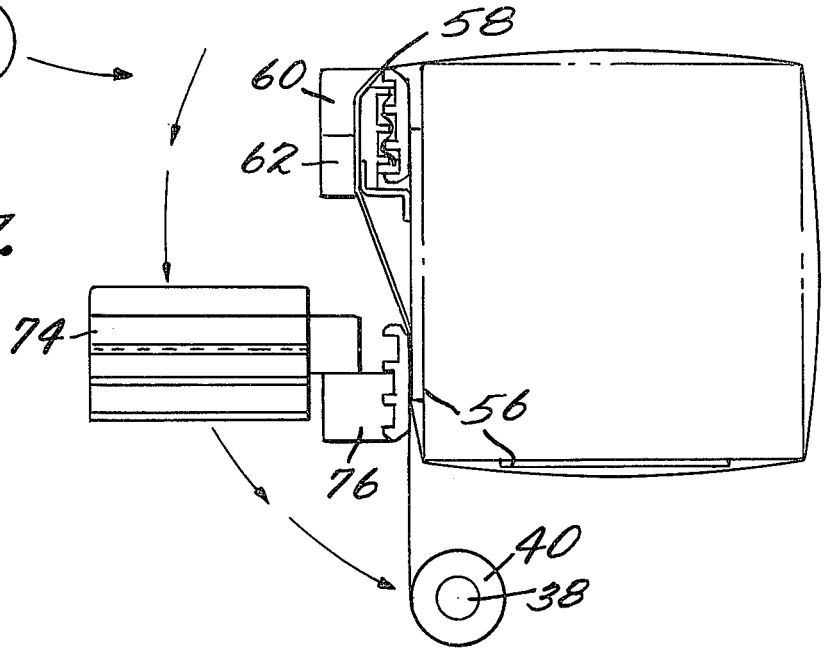
FIG. 7 is a schematic view of the clamp mechanisms after one complete film revolution of the packaging process of the invention.

The operation of the wrapping process, which is shown in more detail in FIGS. 5–10, begins with the leading edge 41 of the film being held between bar member 60 and bar member 62. The appropriate pneumatic cylinders were initially activated so that the film could be inserted between the bar member and clamp closed with the film being held between the clamps and the roll of film 40 in its upper rest position. The load 24 is pushed into the wrapping station by a package inserter plate 91 and the package inserter plate is then retracted so that it is positioned in its initial position. The roll support member 22 is rotated counterclockwise by the drive wheel 30 with the film being stretched by the brake apparatus 42 and wrapped around the top surface of the lower bar member 62 and the load to form a single wrap. As shown in FIG. 7, the film roll 40 continues to be carried around member 62 and at this time the planar surface of bar member 76 of the second clamp mechanism is positioned against the stretch film. It should be noted that the planar surface does not engage the guide plate 56 so that no clamping force occurs between the clamp and the plate. In operation both clamp surfaces are positioned approximately ⅛ of an inch from the plate surface. The film roll 40 continues to be carried around the load as seen in FIG. 8 and covers the ridges and grooved surface of the bottom bar member 76. The roll continues on and stops at a position beyond the bar member 76 with the film stretched over the ridges and grooves of the bottom bar. The upper bar member 74 of the second clamp mechanism 72 is simultaneously activated to abut the lower bar member 76 so that its ridges or fingers 81 engage and clamp the film against the clamp strips 83 of the lower bar member 76 while the cutter blade 70 severs the film.

At this time the load 24 is ready to exit so the top clamp is opened about a quarter of an inch to allow the film to slide out. The opening of the clamp draws the film away from the clamp strips 83 reducing the frictional force which allows the load to be more easily slid over the bar member.

The wrapped package is ejected from the wrapping station by the next load being pushed into position. The takeaway conveyor 104 pulls the wrapped package away from the wrapping station leaving the apparatus with a new load in position to be wrapped. The elasticity of the film allows it to recover the excess stretch covering the clamp so that it tightly holds the product. The machine is now in position to perform a reverse drive wrap with the film now being held in the second clamp mechanism in the same manner that it was by clamp 58. The film roll is then rotated clockwise through the reversed rotation of the drive wheel 30 frictionally contacting the ring support member 22 in the mannerr previously discussed with each clamp assembly performing the identical functions of the other clamp assembly in the previous wrap. At the end of this reversed direction package wrap, the wrapping machine is in the position previously described in the initial operation stage of the machine. It should be noted that the film manipulator or handling components previously described can be made hollow and porous so that compressed air can be passed through them to lubricate the film sliding over them.

Furthermore, a sealer bar can be used in conjunction with the embodiment described. The sealer bar can also be used as a pad or press against the outer layer or wrap so that the outer layer is either heat sealed to the inner layers of wrap or if it is a tacky material such as polyvinylchloride (PVC) it is pressed onto the outer layer.

While the activation of the pneumatic cylinders to operate the film handlind components are preferably accomplished by mechanical cam acutators not shown, such activation can be accomplished by a timer circuit, limit switch, ring member counter mechanisms, feeler gauges, light sensors or any other suitable means well known in the art for operating pneumatic or hydraulic cylinders in a set sequence. The fluid lines of the cylinders from a fluid source are not shown as such yet are well known in the art and the operation of single and double acting cylinders is also well understood by one familiar with the art.

In the foregoing description the invention has been described with reference to a particular preferred embodiment although it is to be understood that the specific details shown are merely illustrative and that the invention may be carried out in other ways without departing from the true spirit and scope of the following claims.

What is claimed is:

1. Apparatus for wrapping a plurality of loads and unitizing the loads into wrapped packages; comprising conveyor means adapted to receive a succession of loads; each said load comprising a plurality of members, wrapping apparatus positioned adjacent said conveyor means, said wrapping apparatus comprising a frame, a film material dispenser means rotatably mounted on said frame comprising a ring member, a film roll support mounted to said ring member and film tensioning means mounted to said ring member to place a continuous tension on said film causing it to be stretched as it is wrapped around the load a plurality of times, a guide wrapping rail means positioned adjacent said conveyor means adapted to receive said load from said conveyor means and support said load during wrapping, a film handling means positioned adjacent said guide wrapping rail means, said film handling means comprising clamp means adapted to hold film material from said film dispensing means in a fixed position while having the capability of severing said film material, said clamp means comprising two clamp assemblies, each clamp assembly comprising a lower bar member and an upper bar member configured to mate together and hold said film material therebetween with cutting means mounted to at least one of said members, said cutting means cutting said stretched material when said two members are mated together with said members holding one portion of said cut stretched material, mounted to said frame to activate and transport each of said bar members a predetermined distance into and out of the path of film dispensed by said dispenser means, said film dispenser means being adapted to hold film material and wrap said film material around said load, drive means engaging said ring member to drive said film member means in an alternating opposite direction after each wrap cycle so that in the first cycle stretched film material is wrapped around said load, supporting guide rail means and a first clamp assembly while being held by said first clamp assembly with trailing edge portion of said film being severed by a second clamp assembly forming a new leading edge portion which is held by said second clamp assembly, means to transport said wrapped load away from said wrapping apparatus after said first clamp assembly has been gapped, said film dispenser means in the subsequent wrapping cycle rotating in the opposite direction and wrapping a second load, said support guide rail means and said second clamp assembly with said first clamp assembly functioning in the identical manner as the second clamp assembly did in the previous wrap cycle.

2. Apparatus as claimed in claim 1 wherein each clamp assembly comprises two clamping bars, each of said bars having one surface defining a plurality of ridges and grooves, the ridges of each bar being adapted to seat in the groooves of the adjacent bar to hold film therebetween.

3. Apparatus as claimed in claim 2 wherein at least one of the bars has a resilient means mounted in at least one groove to provide a clamping surface and at least one of the bars has a cutting blade mounted thereto which severs said film material simultaneously while said film material is being clamped.

4. Apparatus as claimed in claim 2 wherein one of the bars of each clamp assembly has a guide member secured to the bar body, said guide member having an arm running substantially parallel to an outer surface of the bar to engage and contact said film surface pressing the trailing edge of the film wrap against the adjacent film layer surface.

5. Apparatus as claimed in claim 2 wherein said ridges have a substantially planar surface and the bars are substantially rectangular in configuration with substantially planar outer surfaces.

6. Apparatus as claimed in claim 1 including brake means mounted to said film dispenser means, said brake means being adapted to engage the outer surface of a roll of material mounted on said film dispenser to place tension on said roll stretching the film material being dispensed from said roll onto said load.

7. Apparatus for wrapping a plurality of loads and unitizing the loads into wrapped packages; comprising a wrapping apparatus adapted to receive a succession of loads each of which comprises a plurality of units, said wrapping apparatus comprising a frame, a stretchable material dispenser means mounted on said frame, a stretchable material roll support mounted to said material dispenser means and stretchable material roll brake means mounted to said material dispenser means to apply a tension for stretching material wrapped around said load, material handling means positioned adjacent said load, said material handling means comprising a cylinder support, a plurality of fluid operated cylinders mounted to said cylinder support, means to activate said fluid operated cylinders and clamp means operatively connected to said fluid operated cylinders, said clamp means being adapted to hold stretched material from said material dispenser means in a fixed position and comprising two clamp assemblies, each of which alternately holds the stretched material in a fixed position through at least one revolution of a wrapping cycle, each clamp assembly comprising two elongated members adapted to mate together and hold said stretched material therebetween with cutting means mounted to at least one of said members, said cutting means cutting said stretched material when said two members are mated together with said members holding one portion of said cut stretched material, said fluid operated cylinders being adapted to separately transport each of said members a predetermined distance, said material dispenser means being adapted to hold stretchable material and be driven by drive means to wrap said stretched material around said load and a first clamp assembly in one direction at least two revolutions, said stretchable material being held by said first clamp assembly by its leading edge portion. the trailing edge portion of said stretchable material being severed by said second clamp assembly to form a new leading edge of stretchable material which is held by said second clamp assembly, said first clamp assembly being opened sufficiently to allow the stretched material to slide out allowing said wrapped load to be transported away from said wrapping apparatus as the stretched wrap slides over said first clamp assembly, said dispenser means then being driven by drive means in an opposite direction wrapping material around a second following load and said second clamp assembly with said first clamp assembly in this following wrapping cycle being operated to sever the trailing portion and hold a new leading edge portion of the stretchable material.

8. Apparatus as claimed in claim 7 wherein said fluid operated cylinders are pneumatic cylinders.

9. Apparatus as claimed in claim 7 wherein said fluid operated cylinders are hydraulic cylinders.

10. Apparatus as claimed in claim 7 including a guide wrapping rail means, said guide wrapping rail means comprising two plates angularly positioned with respect to each other.

11. Apparatus as claimed in claim 7 wherein said drive means is a friction drive wheel.

12. Apparatus as claimed in claim 7 wherein said brake means is self adjusting to place a constant tension on a film material roll causing said film material to stretch when wrapped around said load.

13. Apparatus as claimed in claim 7 wherein said film handling means includes heat seal means.

14. Apparatus as claimed in claim 7 wherein said brake means comprises a support secured to said film roll holding means, a shaft mounted to said support, at least one roller member rotatably mounted to said shaft and a tension mechanism mounted to said shaft adapted to place a constant torque on said shaft restricting rotation of each roller member, said roller member engaging said material roll placing a pressure on said roll causing said material to uniformly stretch as it is dispensed.

15. Apparatus as claimed in claim 7 wherein said wrapping apparatus includes air cushion means to lubricate the clamp mechanism clamp bars.

16. Apparatus as claimed in claim 7 wherein each clamp assembly comprises two clamping bars, each of said bars having a surface defining a plurality of ridges and grooves opposing each other forming a tongue and groove configuration allowing for mating of the bars and cutting blade means mounted to one of said bars.

17. Apparatus as claimed in claim 7 wherein one of the bars of each clamp assembly has a guide member secured to the bar body, said guide member having an arm running substantially parallel to an outer surface of the bar to engage and contact the outer surface of the film wrap so that the severed trailing edge portion is placed in engagement with the underlying film layer.

18. Apparatus as claimed in claim 16 wherein the opposite surface from the tongue and groove surface of each of said bars is substantially planar.

19. Apparatus for wrapping a plurality of loads, each load comprising a plurality of separate members which are unitized into a wrapped package; comprising a wrapping apparatus adapted to receive a succession of loads each of which comprises a plurality of members, said wrapping apparatus comprising a frame, a ring shaped film material dispenser means having a film roll support secured thereto rotatably mounted on said frame, means to drive said ring shaped dispenser means, brake tension means adapted to substantially stretch film mounted on said film roll support, a guide wrapping rail means comprising a planar plate structure adapted to receive and support said load during wrapping of the load, film handling means positioned adjacent said guide wrapping rail means, said film handling means comprising a cylinder support structure secured to said frame, a plurality of fluid operated cylinders mounted to said support structure, means to activate said fluid operated cylinders and move clamp means connected to said fluid operated cylinders, said clamp means being adapted to hold film material from said film material dispensing means in a fixed position and comprising two clamp assemblies, each clamp assembly comprising a base member having one surface defining a groove and ridge configuration, an opposing member having one surface opposing said base member surface, said opposing surface defining a groove and ridge configuration, said defined member surfaces being adapted to mate together and hold said film material therebetween, and a cutting blade means mounted to one of said members which severs said stretched film simultaneously with mating of said opposing and base members, said fluid operated cylinders being adapted to separately transport each of said members while holding one portion of said cut streched material a predetermined distance into and out of the film path of film dispensed by said dispensing means, said film dispenser means being adapted to hold a roll of film material on said film roll support and wrap a film web which is substantially stretched by said brake means a plurality of times around said load, said supporting guide rail means and a first clamp assembly, while said film web is held by said first clamp assembly with a new leading edge portion of said film web being formed and held and the trailing edge portion severed by said second clamp assembly in one wrap cycle so that said load can be transported away from said wrapping apparatus after said first clamp assembly is gapped by sliding the film web wrap over said first clamp assembly and said supporting guide rail means, said film dispenser means being driven by said drive means in an opposite direction wrapping material around a second load, said supporting guide rail means and said second clamp assembly with said first clamp assembly being operated to sever the trailing edge and hold a new leading edge of the film for the following wrap cycle.

20. Apparatus as claimed in claim 20 wherein the bar members of said first clamp assembly and the bar members of said second clamp assembly have the same configuration positioned in mirror image.

21. Apparatus as claimed in claim 20 wherein each of said bar members comprises a linear body having a planar outer surface and an inner surface defining at least two channels and three ridges, one of said bar members being provided with a cutter bar mounted to a ridge, said cutter bar being constructed to extend into a channel formed in the opposite positioned bar.

22. Apparatus for wrapping a plurality of loads and unitizing the loads into wrapped packages; comprising a wrapping apparatus adapted to receive a succession of loads each of which comprises a plurality of units, said wrapping apparatus comprising a frame, a plastic film material dispenser means rotatably mounted on said frame, a film roll support mounted to said film material dispenser means and film roll brake means mounted to said film dispenser means to apply a substantially constant tension on said film for stretching film wrapped around said load, film material handling means positioned adjacent said load, said film material handling means comprising a cylinder support, a plurality of fluid operated cylinders mounted to said cylinder support, means to activate said fluid operated cylinders and clamp means operatively connected to said fluid operated cylinders, said clamp means being adapted to hold stretched film material from said film material dispenser means in a fixed position and comprising two clamp assemblies, each of which alternately holds the stretched material in a fixed position through at least one revolution of a wrapping cycle, each clamp assembly comprising two elongated members comprising a base member and an opposing member adapted to mate together across the width of the film material and hold said stretched film material therebetween with cutting means mounted to at least one of said members, said cutting means cutting stretched film material when said two members are mated together with said members holding one portion of said cut stretched film material, the severed portion being transported from between said members as the stretched film material returns to its original unstretched state, said fluid operated cylinders being adapted to separately transport each of said members independent of each other a predetermined distance, said film material dispenser means being adapted to hold stretchable film material and to be driven by drive means to wrap said stretched film material around said load and a first clamp assembly in one direction a plurality of times, said stretched film material being held by said first clamp assembly by its leading edge portion, the trailing edge portion of said stretched film material being severed by said second clamp assembly to form a new leading edge of stretched film material which is held by said second clamp assembly, said first clamp assembly being gapped to allow the stretched film material to slide out allowing said wrapped load to be transported away from said wrapping apparatus by sliding the stretched multiple layer film wrap over said first clamp assembly, said dispenser means then being driven by drive means in an opposite direction wrapping stretched film material around a second following load and said second clamp assembly with said first clamp assembly in this following wrapping cycle being operated to sever the trailing portion of the stretched film material and hold a new leading edge portion of the stretched film material.

23. Apparatus as claimed in claim 22 wherein each of said bar members comprises a linear body having a smooth outer surface and an inner surface defining a plurality of channels and ridges, one of said bar members being provided with a cutter means mounted thereto which extends into a channel formed in the opposite positioned bar when the bars mate leaving a gap between the cutter edge and the opposing surface, said bar members being formed so that a gap is formed between the opposing surfaces of the bar members from the cutter edge to the end of the bar members on the trailing edge portion side of the clamp assembly.

* * * * *